US007242305B2

(12) United States Patent
Cuddihy et al.

(10) Patent No.: US 7,242,305 B2
(45) Date of Patent: Jul. 10, 2007

(54) DEVICE AND METHOD FOR MONITORING MOVEMENT WITHIN A HOME

(75) Inventors: Paul Edward Cuddihy, Ballston Lake, NY (US); Keith Donald Kuhnly, Lino Lakes, MN (US); Paul Glendenning Saldin, Stillwater, MN (US)

(73) Assignee: General Electric Company, Niskayuna, NY (US)

( * ) Notice: Subject to any disclaimer, the term of this patent is extended or adjusted under 35 U.S.C. 154(b) by 118 days.

(21) Appl. No.: 10/822,233

(22) Filed: Apr. 9, 2004

(65) Prior Publication Data

US 2005/0237179 A1 Oct. 27, 2005

(51) Int. Cl.
*G08B 13/14* (2006.01)

(52) U.S. Cl. ..... 340/573.1; 340/506; 340/517; 340/523; 340/545.3

(58) Field of Classification Search ..... None
See application file for complete search history.

(56) References Cited

U.S. PATENT DOCUMENTS 4,346,427 A * 8/1982 Blissett et al. ..... 361/173
4,524,243 A * 6/1985 Shapiro ..... 379/38
4,947,152 A * 8/1990 Hodges ..... 340/573.4
5,045,839 A * 9/1991 Ellis et al. ..... 340/539.11
5,153,560 A * 10/1992 Ichikawa ..... 340/522
5,410,297 A * 4/1995 Joseph et al. ..... 340/573.7
5,471,198 A * 11/1995 Newham ..... 340/573.4
5,646,594 A * 7/1997 Barben et al. ..... 340/567
5,692,215 A 11/1997 Kutzik et al.
5,701,117 A * 12/1997 Platner et al. ..... 340/567
5,724,990 A * 3/1998 Ogino ..... 600/587
5,905,436 A * 5/1999 Dwight et al. ..... 340/573.1
5,949,333 A * 9/1999 Lehmann et al. ..... 340/571
6,002,994 A * 12/1999 Lane et al. ..... 702/188
6,078,257 A * 6/2000 Ferraro ..... 340/568.1
6,108,585 A * 8/2000 Ryan et al. ..... 700/112

(Continued)

FOREIGN PATENT DOCUMENTS

EP 0681413 11/1995

(Continued)

OTHER PUBLICATIONS

European Search Report Apr. 20, 2006 for EP 05252174.

*Primary Examiner*—Benjamin C. Lee
*Assistant Examiner*—Son Tang
(74) *Attorney, Agent, or Firm*—Jenifer E. Haeckl; Jean K. Testa

(57) ABSTRACT

A device and method for monitoring whether a resident is away from home or inactive within the home. A sensor, which includes a transmitter, a processor, a timer, and a detector, watches for motion to occur within a home. Upon sensing motion, the sensor sends a first signal indicative of the motion if the timer is not currently running and waits for the motion to end. If the timer already is running, the timer is restarted at zero. Upon expiration of a predetermined timing period, the sensor transmits a second signal indicative of inactivity. By comparing the timing of the second signal and the predetermined timing period, with a third signal sent by an exterior door sensor, a determination can be made whether the resident has left the home or is inactive within the home.

21 Claims, 4 Drawing Sheets

U.S. PATENT DOCUMENTS

| | | | | |
|---|---|---|---|---|
| 6,108,685 | A | 8/2000 | Kutzik et al. | |
| 6,211,783 | B1 | 4/2001 | Wang | |
| 6,445,298 | B1 * | 9/2002 | Shepher | 340/573.1 |
| 6,540,674 | B2 | 4/2003 | Zadrozny et al. | |
| 6,850,159 | B1 * | 2/2005 | Mudge | 340/541 |
| 6,990,394 | B2 * | 1/2006 | Pasternak | 700/295 |
| 2002/0171551 | A1 | 11/2002 | Eshelmkan et al. | |
| 2002/0175815 | A1 | 11/2002 | Baldwin | |

FOREIGN PATENT DOCUMENTS

| | | |
|---|---|---|
| WO | WO 94/20939 | 9/1994 |

* cited by examiner

DEVICE AND METHOD FOR MONITORING MOVEMENT WITHIN A HOME

BACKGROUND

The invention relates generally to a device and method for monitoring activity within a home. More particularly, the invention relates to a device and method for determining, through the monitoring of in-home movement, whether a resident of a home is at home or has left the home.

With medical advancements and increased attention to proper nutrition and sufficient exercise, the populace in the western civilization is living longer. For example, the number of elderly persons residing in the United States is increasing, and with the advancing age of the baby boomer generation, the number of elderly persons in the United States will increase significantly over the next several decades. Additionally, increased awareness and understanding of various mental and physical disabilities has led to an increase in the number of persons having diminished mental and/or physical faculties living independently.

With the increase in elderly and disabled persons living independently has come anxiety that these elderly and disabled persons are safe and secure in their own residences. There is increased anxiety by the elderly and disabled living alone that they may become injured or incapacitated and be unable to summon assistance. That anxiety is often shared by loved ones living at a distance from the elderly and/or disabled living independently.

Currently, the anxiety felt by the elderly and disabled living alone, as well as the anxiety felt by their loved ones, is addressed through several avenues. One way to ease anxiety is through frequent visits to the home by a caregiver. Such visits can be intrusive, time consuming, and often inconvenient and not appreciated. Another way is for the elderly or disabled person to move out of the home and move into a facility better able to monitor his health. This, however, strips the person of his independence, is costly and is often unwelcome. Another way is through technological assistance or monitoring of the person in the home.

Such technological systems that assist persons in their home include Personal Emergency Response Systems. In these systems the elderly or disabled individual wears a watch, pendant or other like device and presses a button in the event of an emergency, such as a fall. The depressed button enables an alarm signal. A central monitoring facility provides assistance by responding to the alarm signal and calls the individual to identify the problem. The facility calls a predetermined list of contacts, such as relatives, neighbors or emergency services, as required by the context of the situation. While a valuable service, these systems only identify problems that occur when the individual is able to press the emergency button.

One disadvantage experienced with some known in-home monitoring systems is the inability to accurately detect whether a resident within a monitored home has been unusually inactive or is instead away from the home. These known in-home monitoring systems provide the resident with one or more button that can be pressed to indicate whether the resident is home or is away. The resident's responsibility to indicate whether he is in the house or away often goes unfulfilled, leading to a high false alert rate and low sensitivity for such known systems.

Thus, there remains a need for a device and method for monitoring movement within a home.

SUMMARY

The invention is directed to a system, device and method for ascertaining whether a resident of a monitored home is at home or has left the home.

One aspect of the invention is a wireless motion sensor for determining when motion ceases. The motion sensor includes a detector for detecting activity, a transmitter for transmitting a first signal indicative of a first detection of activity, a processor, and a timer that begins running upon a first detection of activity. Upon the timer running to a set time period without detection of any subsequent activity after the first detection of activity, the transmitter transmits a second signal indicative of inactivity.

Another aspect of the invention is a wireless motion sensor for determining when motion ceases. The motion sensor includes a detector for detecting activity, wherein the detector comprises a signal processor and a sensing portion, a transmitter for transmitting a first signal indicative of a first detection of activity, wherein the transmitter is adapted for wirelessly transmitting the first and second signals, a processor, and a timer which begins running upon a first detection of activity. Upon the timer running to a set time period without detection of any subsequent activity after the first detection of activity, the transmitter transmits a second signal indicative of inactivity.

Another aspect of the invention is a method for determining inactivity within a home. The method includes the steps of watching for an indication of motion, sensing motion, wirelessly sending a first signal indicative of the motion, starting a timer for a predetermined period of time, and upon expiration of the predetermined period of time without sensing any further motion, wirelessly sending a second signal indicative of inactivity.

Another aspect of the invention is a method for determining inactivity within a home. The method includes the steps of watching for an indication of motion, sensing motion, wirelessly sending a first signal indicative of the motion via a transmitter, and starting a timer for a set time period no greater than five minutes. Upon expiration of the set time period without sensing any further motion, a second signal indicative of inactivity is wirelessly sent.

These and other advantages and features will be more readily understood from the following detailed description of preferred embodiments of the invention that is provided in connection with the accompanying drawings.

DETAILED DESCRIPTION OF PREFERRED EMBODIMENTS

Figure 1:
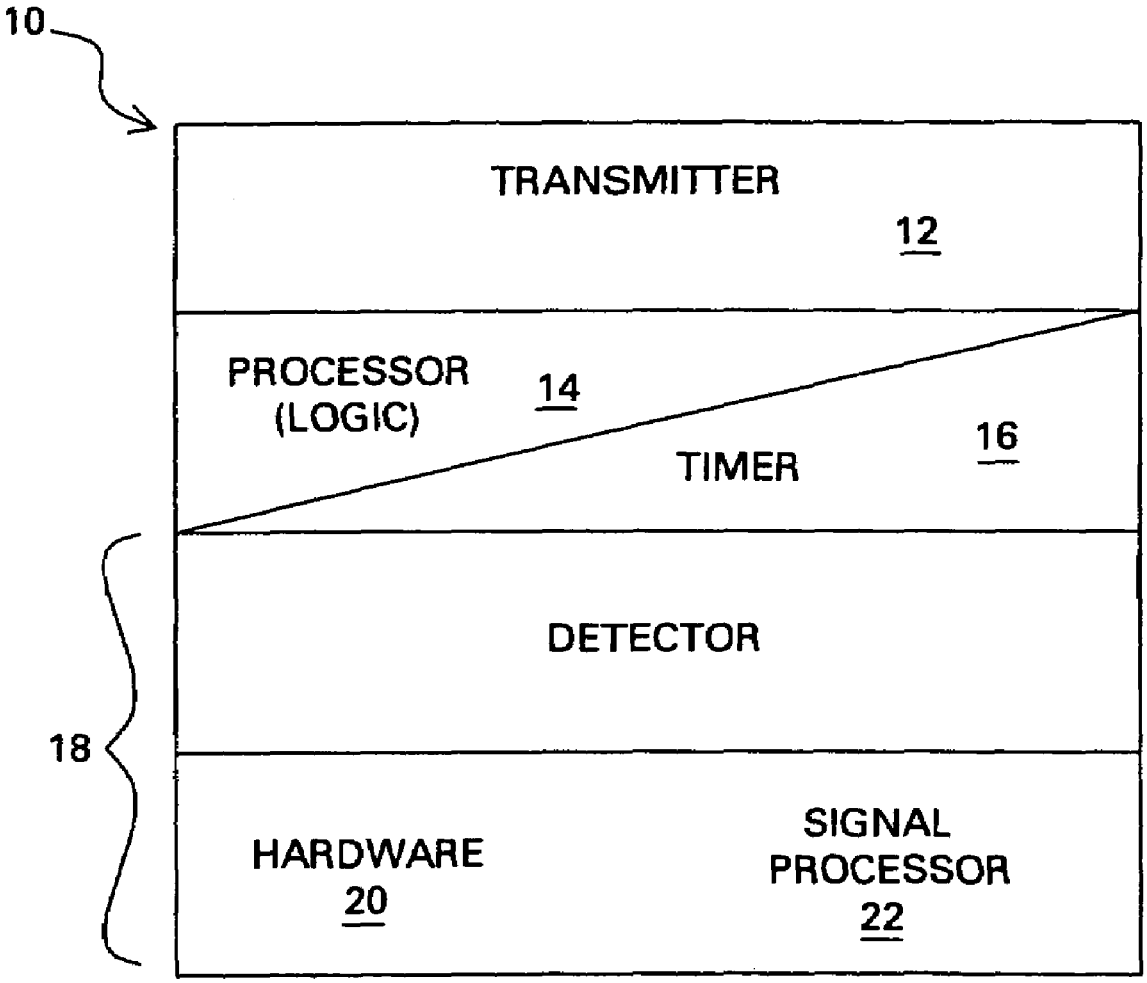
FIG. 1 is a schematic view of a motion sensor constructed in accordance with an exemplary embodiment of the invention.

Referring now to the drawings, where like numerals relate to like features, there is shown in FIG. 1 a wireless motion sensor 10 constructed in accordance with an exemplary embodiment of the invention. The motion sensor 10 includes a transmitter 12, a processor 14, and a timer 16. The processor 14 includes logic portions of the sensor 10.

The motion sensor 10 further includes a detector section 18. The detector section 18 includes a hardware portion 20 and a signal processor 22. The hardware portion 20 includes a sensing portion that detects motion. The hardware portion 20 serves to pass an amplified and filtered version of the output of the sensing portion to the signal processor 22. The signal processor 22 includes necessary logic to determine if the signal coming from the hardware portion 20 constitutes an alarm. The hardware portion 20 preferably includes a passive infrared motion detector mechanism. Alternatively, the hardware portion may include ultrasonic, microwave, radar, or infrared motion detectors, or any combinations of these, such as, for example, infrared with microwave or infrared with radar. The signal processor 22 takes signals from the hardware portion 20 and determines what is motion.

Figure 2:
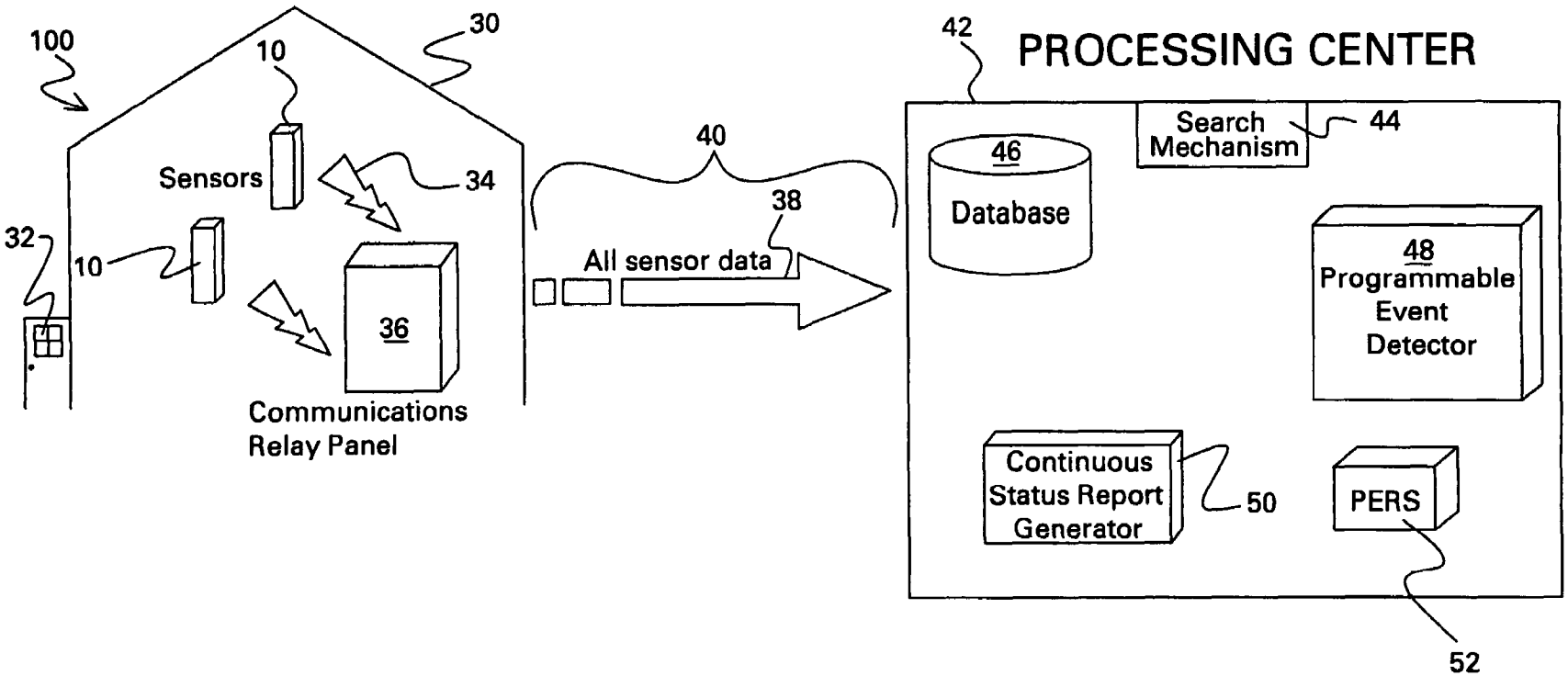
FIG. 2 is a schematic view of a system using the motion sensor of FIG. 1.

With reference to FIG. 2, an activity monitoring system 100, including the motion sensor 10, is illustrated. The activity monitoring system 100 includes, in addition to one or more motion sensors 10, one or more exterior door sensors 32, a communication relay panel 36, and a remote monitoring center 42. The activity monitoring system 100 lacks mechanisms to intervene in the home 30 or any subsystems (appliances, water, lights, etc.) of the home 30. Intervention in the home 30, if any, may arrive through a communication with the resident of the home 30 from outside the home, such as via a telephone call or a visit from a caregiver or other suitable person, such as an emergency response professional. The motion sensors 10 may include sensors positioned about the home 30 to detect activity of the resident, or may be inside door sensors, cabinet sensors, kitchen and appliance sensors, and any other sensors suitable for collecting and communicating data regarding activities on-going in the home 30. Further, the motion sensors 10 may take any suitable form, such as, for example, a module attached to a wall, interior door, appliance, or cabinet drawer. Alternatively, the motion sensors 10 may take the form of a pad placed upon a bed, couch or chair to monitor a resident's use of same. The exterior door sensors 32 may be one or more sensors positioned on doors providing ingress and egress from the home 30. Preferably, the sensors 10, 32 are wireless sensors capable of wirelessly communicating signals 34, which include data collected, to the communications relay panel 36. It should be appreciated, however, that the sensors 10, 32 instead may be sensors hardwired to the communications relay panel 36.

The communications relay panel 36 communicates the sensor data collected from the sensors 10, 32 by sending a data signal 38 containing the sensor data to the remote monitoring center 42 by way of a suitable wired or wireless communications platform 40, such as, for example, wired telephone, wireless telephone, two-way walkie-talkie, pager, cable, the Internet browser, or any other wireless communication platform. Depending upon the communication platform 40 chosen, the data signals 38 may be sent in near real-time or may be sent at discrete, irregular intervals. By near real-time is meant within the range of almost instantaneously to up to three minutes. For example, data signals 38 may be sent in near real-time via wireless telephone, two-way walkie-talkie, pager, cable, the Internet browser or any other wireless communication platform. For a wired telephone communication platform, the data signals 38 are buffered and transmitted at differing intervals.

The monitoring center 42, which is remote from the home 30, includes a database 46, a programmable event detector 48, and a continuous status report generator 50. The database 46 serves as a collection vessel for the sensor data communicated via the signals 38. A search mechanism 44 is used for searching the database 46. Upon a request from the caregiver for a status report, the sensor data is forwarded from the database 46 to the continuous status report generator 50. The status report generator 50 communicates a near real-time status signal to a personal computer of the caregiver. By near real-time is meant anywhere in the range of almost instantaneously to up to three minutes. For example, for a two-way page communication platform 40, the amount of time required for the communication can be between two and three minutes. The status report generator 50 may be programmed to update the report for each home 30 at a certain interval, such as, for example, every ten minutes. The status signal includes a report generated by the continuous status report generator 50. The format and substance of the report are dependent upon the request of the caregiver and can be modified at the request of the caregiver. It should be appreciated that the signal can instead be communicated via a personal digital assistant (PDA), a pager, a facsimile machine, cable, or a telephone or voice-mail account instead of via the personal computer.

The caregiver 38 can also select certain activities that, if they occur in the home 30, would be considered an event. An event, in general, would include an activity or any important transition occurrence, such as a state transition (the change from one state to another, such as, for example, from active to quiet), of which a caregiver would want to be apprised. For example, use of an exterior door may be considered an important activity or state transition occurrence. The caregiver communicates the parameters of what constitutes an event to the remote monitoring center 42 via a signal. While the caregiver does not determine whether an event has occurred, the caregiver can select from a set of predefined activities which constitutes an event. Further, the caregiver sets the parameters to configure the events to match the normal activity of the resident in the home 30. For example, the caregiver does not define what constitutes, for example, "wake up", but the caregiver can define when "wake up" would be considered late. The sensor data is stored and processed at the monitoring center 42. If the data indicates the occurrence of an event, a signal is sent to the caregiver via any suitable communication medium, such as, for example, wired or wireless telephone, PDA, pager, facsimile, cable, two-way walkie-talkie, e-mail, or other Internet-supported communication media, such as, for example, through a pop-up announcement format. The caregiver is then provided the opportunity to open a communication pathway with the person residing in the home 30. The communication pathway may be through a wired or wireless telephone line, the Internet browser (i.e., e-mail or other Internet-sponsored communication tool), cable, PDA, pager, or personal, such as a visit by the caregiver or another suitable person.

The sensors 10, 32 can be positioned in various locations throughout the home 30. The sensors 10, 32 may be categorized by types, for example, as motion, exterior door (sensor 32), food, or automobile sensors. It should be appreciated that the number of sensors 10, 32 used may depend upon the layout of the home 30, as well as other factors.

Figure 4:
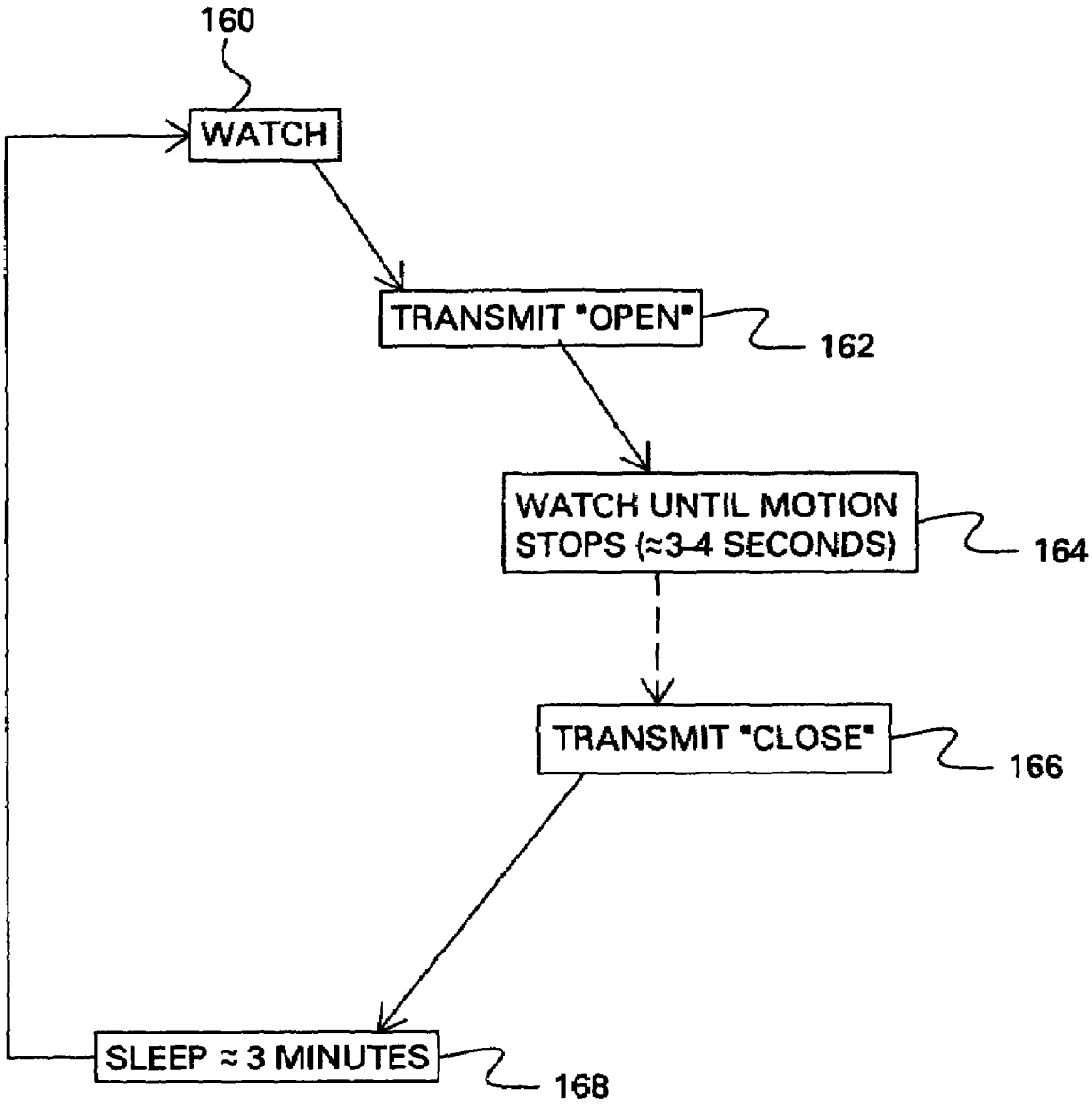
FIG.4 (PRIOR ART)
FIG. 4 is a flow diagram of the process steps taken by a conventional motion sensor in ascertaining whether a resident is at home or away.

Next, with specific reference to FIG. 4, will be described a conventional process for determining when motion is occurring in a room monitored by a motion sensor. At Step 160, the motion sensor watches for any detectable sign of motion or activity. When motion is detected, an "Open" signal is transmitted at Step 162. At Step 164, the motion sensor continues to watch until no further motion has been seen for about three to four seconds. At this juncture, the sensor may optionally transmit a "Close" at Step 166. The sensor, regardless of whether Step 166 occurs, then goes to sleep, or temporarily becomes inactive, for about three minutes at Step 168.

By going to sleep at Step 168, the use of conventional motion sensors may lead to anomalous results. For example, a resident may open an exterior door, such as a door off of the kitchen to put out the garbage, put out the garbage and close the door and move to the bedroom within a time span of less than three or four minutes. By opening the exterior door, the conventional motion sensor has reported an open at Step 162, and then gone into the sleep mode at Step 168. During that sleep mode, the resident has ample time to close the exterior door, go to his bedroom and go to bed. Under such a scenario, the system will sense no further movement within the home, thus leading the system to conclude that the resident has left the home.

The motion sensors 10 within the activity monitoring system 100 utilize a different logic scheme to address the disadvantages of the approximately four-minute long sleep period experienced by conventional motion sensors.

Figure 3:
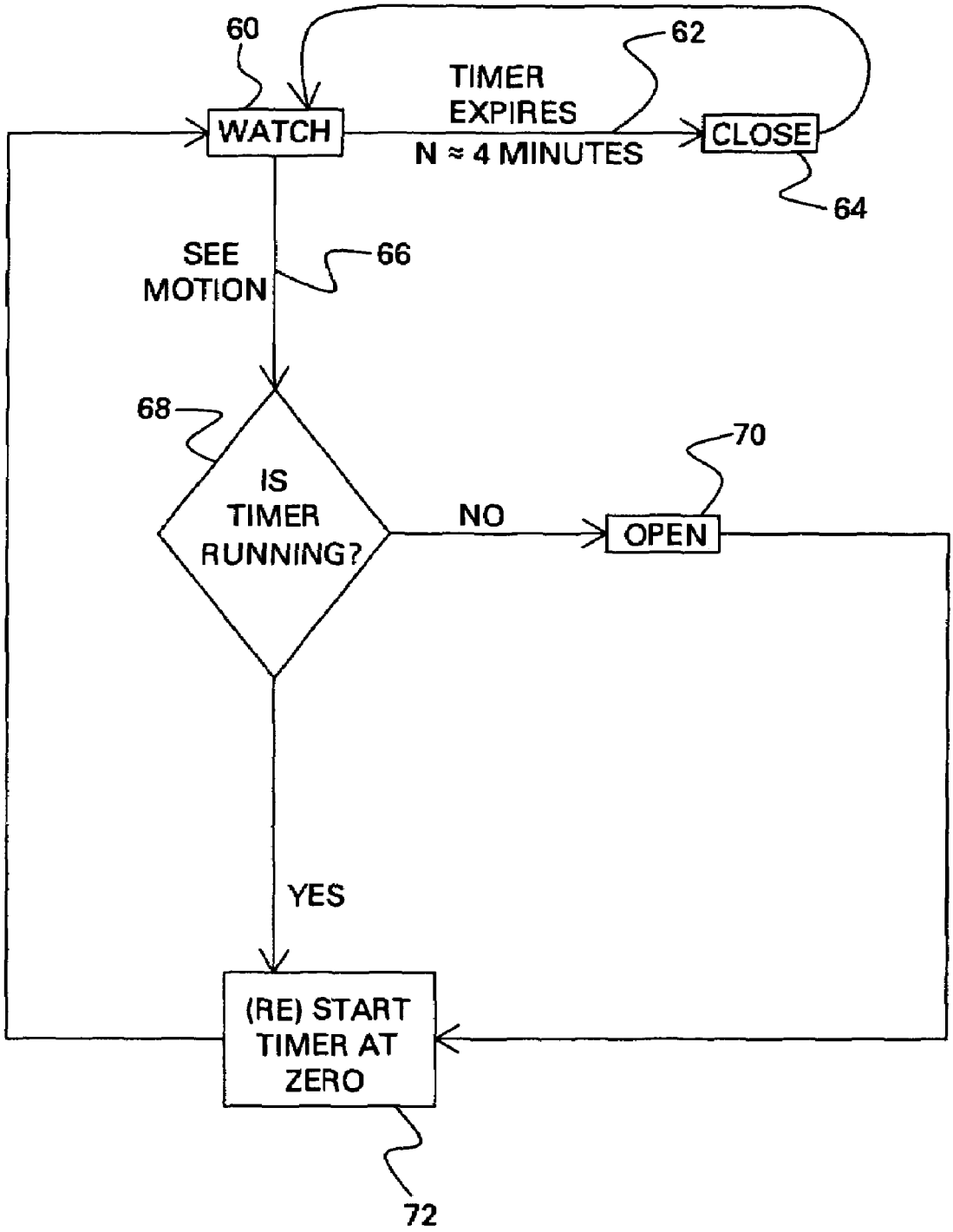
FIG. 3 is a flow diagram of the process steps taken by the motion sensor of FIG. 1 in ascertaining whether a resident is at home or away.

With reference to FIG. 3, next will be described the flow logic of the motion sensors 10. At Step 60, the detector 18 of the motion sensor 10 watches for any detectable sign of motion or activity. While the motion sensor 10 watches for activity, the timer 16 (FIG. 1) is running. If the motion sensor 10 sees motion at Step 66, the processor 14 initiates a query 68 as to whether the timer 16 is running. Upon seeing motion for the first time, the timer 16 will not be running, and thus, at Step 70 an open is reported via a first signal from the transmitter 12. By open is meant that the detector 18 has detected activity. The detector 18 of the motion sensor 10 will continue to watch; however, no further motion will be reported, as continuous reporting takes up battery power. If the timer 16 is running, at Step 72 the timer 16 is restarted at zero. If the timer 16 is not running and after the open has been reported, the timer 16 is started at zero at Step 72. After Step 72, the logic returns to Step 60 and the motion sensor 10 watches for renewed motion. Typically, motion occurs intermittently, and so if the detector 18 sees motion again at Step 66 before the timer expires at Step 62, the answer to the query at Step 68 will be yes, and that will be followed by a restarting of the timer 16 at zero at Step 72.

Upon expiration of the timer 16, which was started or restarted at Step 72 and which occurs after N minutes at Step 62, at Step 64 a close is reported via a second signal from the transmitter 12. By close is meant that no activity has been detected within the N time period. Preferably, the N time period for which the timer 16 runs before expiring is about four minutes. It should be appreciated, however, that any amount of time should be suitable as long as the N time period is known. Higher values of N will extend battery life. After reporting a close at Step 64, the logic returns to Step 60.

The open and the close are both reported by transmitting the first and second signals to a personal emergency response system or other external system ("PERS") 52 (FIG. 2). The PERS 52 knows the length of time the timer 16 runs, and thus a simple subtraction of the length of time the timer 16 has run from the time the close was reported at Step 64 will provide an actual time that activity ceased within the home 30. By comparing the actual time that activity has ceased in the home 30 with data from the external door sensors 32, an accurate determination as to whether inactivity within the home 30 is due to the resident being away from the home 30 can be made. Alternatively, whether inactivity within the home 30 is due to the resident ceasing to move also can be more accurately determined.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed as new and desired to be protected by Letters Patent of the United States is:

1. A wireless monitoring system, comprising:

one or more motion sensors for determining when motion ceases, comprising, a detector for detecting activity;

a transmitter for transmitting a first signal indicative of a first detection of activity to a monitoring center;

a processor for processing at least said first signal indicative of said first detection of activity; and a timer which begins running upon a first detection of activity;

wherein upon the timer running to a set time period without detection of any subsequent activity after the first detection of activity, the transmitter transmits a second signal indicative of inactivity to a monitoring center; and wherein said detector is adapted to continue watching for activity after said transmitter transmits said second signal indicative of inactivity; and said monitoring center for monitoring said activity, comprising an activity report generator.

2. The wireless motion sensor of claim 1, wherein the transmitter is adapted for wirelessly transmitting the first and second signals.

3. The wireless motion sensor of claim 1, wherein the detector comprises a signal processor and a sensing portion.

4. The wireless motion sensor of claim 3, wherein the sensing portion comprises at least one sensing mechanism utilizing a sensing technique from the group consisting of passive infrared, ultrasound, microwave, radar, infrared, and any combinations thereof.

5. The wireless motion sensor of claim 3, wherein the sensing portion includes a passive infrared detecting mechanism.

6. The wireless motion sensor of claim 1, wherein the set time period is no greater than five minutes.

7. The wireless motion sensor of claim 1, wherein the sensor is configured to detect activity in the vicinity of one or more from the group consisting of interior doors, cabinet drawers, appliances, beds, couches or chairs.

8. The wireless motion sensor of claim 7, wherein the sensor comprises a pad for detecting activity.

9. A wireless monitoring system, comprising:

motion sensor for determining when motion ceases, comprising, a detector for detecting activity, wherein the detector comprises a signal processor and a sensing portion;

a transmitter for transmitting a first signal indicative of a first detection of activity, wherein the transmitter is adapted for wirelessly transmitting the first signal and a signal to said monitoring center;

a processor; and a timer which begins running upon a first detection of activity;

wherein upon the timer running to a set time period without detection of any subsequent activity after the first detection of activity, the transmitter transmits said second signal indicative of inactivity; and wherein said detector is adapted to continue watching for activity after said transmitter transmits said second signal indicative of inactivity; and said monitoring center for monitoring said activity, comprising an activity report generator.

10. The wireless motion sensor of claim 9, wherein the sensing portion comprises at least one sensing mechanism utilizing a sensing technique from the group consisting of passive infrared, ultrasound, microwave, radar, infrared, and any combinations thereof.

11. The wireless motion sensor of claim 9, wherein the sensing portion includes a passive infrared detecting mechanism.

12. The wireless motion sensor of claim 9, wherein the set time period is no greater than five minutes.

13. The wireless motion sensor of claim 9, wherein the sensor is configured to detect activity in the vicinity of one or more from the group consisting of interior doors, cabinet drawers, appliances, beds, couches or chairs.

14. The wireless motion sensor of claim 13, wherein the sensor comprises a pad for detecting activity on one or more from the group consisting of beds, couches or chairs.

15. A method for determining inactivity within a home, comprising the steps of:

watching for an indication of motion;

sensing motion;

wirelessly sending a first signal indicative of the motion via a transmitter to a monitoring center;

starting a timer for a set time period;

upon expiration of the set time period without sensing any further motion, wirelessly sending a second signal indicative of inactivity via said transmitter to said monitoring center;

continuing to watch for activity after said transmitter transmits said second signal indicative of inactivity; and generating a report of said inactivity at said monitoring center.

16. The method of claim 15, wherein the sending of the first and second signals is accomplished with a transmitter.

17. The method of claim 15, wherein the watching is accomplished with a sensor utilizing a sensing technique from the group consisting of passive infra-red, ultrasound, microwave, radar, infra-red, and any combinations thereof.

18. The method of claim 15, wherein the set time period is no greater than five minutes.

19. A method for determining inactivity within a home, comprising the steps of:

watching for an indication of motion;

sensing motion;

wirelessly sending a first signal indicative of the motion via a transmitter;

starting a timer for a set time period no greater than five minutes;

upon expiration of the set time period without sensing any further motion, wirelessly sending a second signal indicative of inactivity via a transmitter;

continuing to watch for activity after said transmitter transmits said second signal indicative of inactivity and transmitting one or more signals, that are indicative of said inactivity, to a monitoring center, and generating a report of said inactivity.

20. The method of claim 19, wherein the watching for the indication of motion is accomplished with a sensor utilizing a sensing technique from the group consisting of passive infra-red, ultrasound, microwave, radar, infra-red, and any combinations thereof.

21. The method of claim 19, further comprising determining a time actual inactivity occurs within the home based upon the time the second signal is sent and the length of the set time period.

* * * * *